United States Patent [19]

Koike

[11] Patent Number: 4,467,336

[45] Date of Patent: Aug. 21, 1984

[54] HEAT-SENSITIVE RECORDING SHEET WITH IMPROVED PRINTABILITY AND PROCESS FOR PRODUCING THE SAME

[75] Inventor: Naomasa Koike, Tokyo, Japan

[73] Assignee: Mitsubishi Paper Mills, Ltd., Tokyo, Japan

[21] Appl. No.: 511,655

[22] Filed: Jul. 7, 1983

[30] Foreign Application Priority Data

Jul. 9, 1982 [JP] Japan ..... 57-120332
Sep. 2, 1982 [JP] Japan ..... 57-153071

[51] Int. Cl.[3] ..... B41M 5/18

[52] U.S. Cl. ..... 346/200; 346/207; 427/150; 427/151; 427/359; 427/361; 427/363

[58] Field of Search ..... 282/27.5; 427/150–153, 427/359, 361, 363; 428/211, 320.4–320.8, 411, 488, 537, 913, 914

[56] References Cited

U.S. PATENT DOCUMENTS 4,032,690 6/1977 Kohmura et al. ..... 428/488
4,098,114 7/1978 Asao et al. ..... 282/27.5

*Primary Examiner*—Bruce H. Hess
*Attorney, Agent, or Firm*—Cushman, Darby & Cushman

[57] ABSTRACT

In ordinary heat-sensitive sheets using a colorless to light-colored dye precursor and a color developer which causes said dye precursor to develop a color by reacting with the dye precursor when heated, printability can be improved by establishing the maximum peaks of their void distribution curves at a void diameter of 1.0 μm or less.

6 Claims, No Drawings

HEAT-SENSITIVE RECORDING SHEET WITH IMPROVED PRINTABILITY AND PROCESS FOR PRODUCING THE SAME

BACKGROUND OF THE INVENTION

1. Field of the Invention

This invention relates to a heat-sensitive recording sheet and more particularly to a heat-sensitive recording sheet with improved printability.

2. Description of the Prior Art

In recent years, the heat-sensitive recording method has come to possess various advantages such that it gives almost no impact and accordingly is noiseless, development and fixation is not required and equipment maintenance is simple. Therefore, the method is widely used not only in various printers and telephone facsimile but also in many other areas.

Development of information-recording equipment has hitherto focused mainly on higher speed. Recently, however, even recording equipment with characteristics such as high resolving power and gradation is beginning to be marketed.

These characteristics can not be achieved only by improvement of recording equipment and hence heat-sensitive recording sheets having a printability compatible with the equipment become necessary. Printability of heat-sensitive recording sheets is a characteristic corresponding to the reproducibility of thermal head patterns (dots) at various printing densities. With conventional heat-sensitive recording sheets for high speed facsimiles which put emphasis mainly on thermal response, the reproducibility of dots particularly at low printing densities becomes poor and accordingly good halftone such as obtained in photooriginals can not be reproduced.

SUMMARY OF THE INVENTION

The present inventor found out that printability of heat-sensitive recording sheets can be remarkably improved by increasing densities of these sheets, particularly of their heat-sensitive coating layers.

The present inventor made further studies on densities of heat-sensitive recording sheets by measuring void distribution curves of these sheets, and found out that good printability is obtained when the maximum peak of a void distribution curve exists at a void diameter of 1.0 μm or less.

The heat-sensitive recording sheet of this invention having the maximum peak of its void distribution curve at 1.0 μm or less clearly differs from conventional heat-sensitive recording sheets having the maximum peaks of their void distribution curves at 1.1 to 2.0 μm.

DETAILED DESCRIPTION OF THE PREFERRED EMBODIMENTS

Void distribution curves of papers were obtained by, in accordance with the method described in Japan TAPPI (vol. 33, No. 5, page 40 to 41), plotting pressure-charged quantities against void diameters corresponding to pressures by a mercury porosimeter (1500 type of Caloerba Co.).

A heat-sensitive recording sheet having the maximum peak of its void distribution curve at the void diameter of 1.0 μm or less can be obtained by, after coating a support with a heat-sensitive coating color, (1) passing the coated support through a supercalender with the moisture content of the coated support kept at a level slightly higher than usual, or (2) passing the coated support through a supercalender with the surface temperature of the chilled roll increased to at least 30° C., or (3) passing the coated support through a gloss calender and a heat calender. The methods (1) to (3) can also be used in combination. Among these methods, the method (1) is most preferable. In the method (1), the moisture content of the heat-sensitive coated sheet is kept at 6.5 to 12.0% and in this condition the sheet is subjected to supercalendering, whereby printability of the sheet is remarkably improved.

Heat-sensitive sheets, after having been coated with a heat-sensitive coating color, are passed through a supercalender to be given the smoothness on the coated surface. At this time, these sheets ordinarily have a moisture content of about 6.0% and are in a condition of equilibrium moisture content or over drying. The sheets after supercalendering can be used for copies for documents and the like with no major problems, but are not suitable for copies for photo-originals and the like requiring gradation and high resolving power. These sheets have difficulties particularly in reproduction of halftone.

On the other hand, in heat-sensitive sheets of the present invention which are passed through a supercalender with their moisture content kept at a higher level, compression of the coated layer of the heat-sensitive sheet by the metal roll and the cotton roll is conducted effectively, whereby printability is improved remarkably. Although the moisture content giving good printability varies slightly by components of the coating color, printability improvement is seen at the moisture content of 6.5% compared with the ordinary moisture content of 6%. By increasing the moisture content to 6.5% or above, printability becomes better. However, if the moisture content exceeds 12.0%, it becomes practically difficult to pass heat-sensitive sheets through a supercalender and the work efficiency becomes worse. Hence, in production of heat-sensitive sheets with good printability, the moisture content of coated sheets to be passed through a supercalender is suitably 6.5 to 12.0%.

Controlling of the moisture content of a heat-sensitive sheet at 6.5 to 12.0% when the sheet is passed through a supercalender is conducted by (a) the method wherein mild drying is applied to a sheet coated with a heat-sensitive coating color, in a drying process, or by (b) the method wherein a sheet is moisture-controlled by a moisture controller before the sheet is passed through a supercalender. The method (a) is more preferable. That is, after a sheet has been coated with a heat-sensitive coating color, by controlling drying conditions, the moisture content of the sheet is controlled so as to fall between 6.5% and 12% while taking care for the content not to drop lower than 6.5%, and then in this moisture level the sheet is subjected to supercalendering, whereby printability is remarkably improved.

In the method (b), as the moisture controller, there are generally known a paper master and a moistener in the paper industry. Also, a damping machine is known which supplies water in the form of fog.

A method combining the methods (a) and (b) can also be used.

Even when a sheet is subjected to supercalendering with its moisture content kept lower than 6.5%, the object of this invention can be achieved by adopting the above mentioned method (2) (the surface temperature of the chilled roll be increased to at least 30° C.) or the above mentioned method (3).

Through the above-described process, the density of a heat-sensitive sheet, particularly its heat-sensitive coating layer is increased and the void is decreased, whereby color developability becomes uniform on the coated surface and improved surface smoothness enhances printability.

Next, major components used in the heat-sensitive recording sheet of this invention are explained specifically. However, they are not restricted by the following substances.

(1) Dye Precursor

There can be used dye precursors which are employed generally in heat-sensitive papers. They are, for example, Crystal Violet Lactone, 3-diethylamino-7-methylfluoran, 3-diethylamino-6-chloro-7-methylfluoran, 3-diethylamino-6-methyl-7-chlorofluoran, 3-diethylamino-7-anilinofluoran, 3-diethylamino-7-(2-chloroanilino)fluoran, 3-dibutylamino-7-(2-chloroanilino)fluoran, 3-diethylamino-7-(3-chloroanilino)fluoran, 3-diethylamino-6-methyl-7-anilinofluoran, 3-(N-ethyl-p-toluidino)-6-methyl-7-anilinofluoran, 3-(N-methyl-cyclohexylamino)-3-methyl-7-anilinofluoran, 3- piperidino-3-methyl-7-anilinofluoran, etc.

(2) Color Developer

As the color developer, acidic substances generally used in heat-sensitive papers can be used. There can be mentioned, for example, phenol, p-tert-butylphenol, p-phenylphenol, α-naphthol, p-hydroxyacetophenol, 2,2'-dihydroxydiphenol, 4,4'-isopropylidenebis(2-tert-butylphenol), 4,4'-isopropylidenediphenol, 4,4'-cyclohexylidenediphenol, novolak type phenolic resins, benzoic acid, p-tert-butylbenzoic acid, p-oxybenzoic acid, benzyl p-oxybenzoate, methyl p-oxybenzoate, 3-benzyl-4-hydroxybenzoic acid, β-naphthoic acid, salicylic acid, 3-tert-butylsalicylic acid, 3-methyl-5-tert-butylsalicylic acid, stearic acid, oxalic acid, maleic acid, and so forth.

(3) Binder

For example, starches, hydroxyethyl cellulose, methyl cellulose, polyvinyl alcohols, styrene-maleic anhydride copolymers, styrenebutadiene copolymers, polyacrylic amides, etc.

(4) Pigment

For example, diatomaceous earth, talc, kaolin, calcinated kaolin, calcium carbonate, magnesium carbonate, titanium oxide, zinc oxide, silicon oxide, aluminum hydroxide, urea-formaldehyde resin, etc.

(5) Wax

For example, stearamide, palmitamide, oleamide, lauramide, ethylenebis-stearamide, methylenebis-stearamide, methylolstearamide, paraffin wax, polyethylene, carnauba wax, oxidized paraffin, zinc stearate, etc.

(6) Others

Various auxiliaries can be added. For example, dispersants, defoamants, sensitizers, ultraviolet light absorbers, fluorescent dyes, etc.

(7) Support

There can be generally used sheet-formed materials such as papers and thermoplastic resin films on which a heat-sensitive coating color can be applied.

Next, this invention will be explained in more detail by way of Examples.

Examples 1 to 11, Comparative Examples 1 and 2

(1) Dispersion A (dispersion of a dye precursor)

150 g of 3-diethylamino-6-methyl-7-anilinofluoran was dispersed in 18 g of Malon MS-25 (25% aqueous solution of a sodium salt of a styrenemaleic anhydride copolymer. manufactured by Daido Kogyo K.K.) and 332 g of water. The mixture was ground for 48 hr in a ball mill, whereby Dispersion A was prepared.

(2) Dispersion B (dispersion of a color developer)

150 g of 4,4'-isopropylidenediphenol was dispersed in 18 g of Malon MS-25 and 332 g of water. The mixture was ground for 48 hr in a ball mill, whereby Dispersion B was prepared.

Using the above dispersions, a heat-sensitive coating color was prepared as follows.

| | |
|---|---|
| Calcium carbonate PC (manufactured by Shiraishi Kogyo Kaisha, Ltd.) | 5 parts |
| Dispersion A | 5 parts |
| Dispersion B | 16.7 parts |
| 20% Dispersion of stearamide | 10 parts |
| 15% Dispersion of a polyvinyl alcohol | 25 parts |
| Water | 11.6 parts |

This heat-sensitive coating color was coated on a base paper of 50 g/m² so that the coated quantity after drying became 7.2 g/m². Then, by altering the temperature condition of a dryer, sheets whose moisture contents varied from 5.5% to 12% were prepared. These sheets were passed through a supercalender at 25° C. at an oil pressure of 15 kg/cm², whereby heat-sensitive sheets were produced. Sheets having moisture contents higher than 12% were difficult to be passed through the supercalender because they were liable to cause wrinkles.

These heat-sensitive sheets had maximum peaks of void distribution curves at 0.6 to 1.1 μm, and heat-sensitive sheets having higher moisture contents had maximum peaks at smaller void diameters.

Then, by using a facsimile tester manufactured by Matsushita Electronic Components Co., Ltd. and altering pulse width from 1.0 msec to 2.0 msec, image densities at various pulse widths as well as reproducibility (printability) of thermal head patterns (dots) were examined for these heat-sensitive sheets.

TABLE 1

| No. | Location of the maximum peak of the void distribution curve of a heat-sensitive sheet, μm | Moisture content of a coated sheet when the sheet passes through a supercalender, % | Image density at each pulse width 1.0 msec | 1.5 msec | 2.0 msec | Printability |
|---|---|---|---|---|---|---|
| Comparative Example 1 | 1.1 | 5.5 | 0.26 | 0.69 | 0.95 | x |
| Comparative Example 2 | 1.05 | 6.0 | 0.30 | 0.70 | 0.96 | x |
| Example 1 | 1.0 | 6.5 | 0.32 | 0.73 | 0.96 | Δ |
| Example 2 | 0.9 | 7.0 | 0.37 | 0.76 | 0.97 | ○ |
| Example 3 | 0.9 | 7.2 | 0.38 | 0.76 | 0.98 | ○ |

TABLE 1-continued

| No. | Location of the maximum peak of the void distribution curve of a heat-sensitive sheet, μm | Moisture content of a coated sheet when the sheet passes through a supercalender, % | Image density at each pulse width 1.0 msec | 1.5 msec | 2.0 msec | Printability |
|---|---|---|---|---|---|---|
| Example 4 | 0.85 | 7.5 | 0.38 | 0.77 | 0.99 | ○ |
| Example 5 | 0.8 | 8.2 | 0.39 | 0.78 | 0.99 | ◎ |
| Example 6 | 0.8 | 8.5 | 0.40 | 0.78 | 1.00 | ◎ |
| Example 7 | 0.7 | 9.2 | 0.40 | 0.78 | 1.00 | ◎ |
| Example 8 | 0.65 | 10.0 | 0.40 | 0.78 | 1.00 | ◎ |
| Example 9 | 0.65 | 10.7 | 0.41 | 0.80 | 1.00 | ◎ |
| Example 10 | 0.60 | 11.5 | 0.41 | 0.80 | 1.01 | ◎ |
| Example 11 | 0.60 | 12.0 | 0.42 | 0.81 | 1.01 | ◎ |

In the column of printability, means the best printability, o the second best, Δ the third best and x the worst.

In general, reproducibility of dots, namely, printability tends to be worse at lower image densities. However, in Table 1, in heat-sensitive sheets whose printability ratings were ◎, good printability was obtained even at lower densities, and in heat-sensitive sheets of ○ and Δ printability ratings, printability at lower densities was slightly inferior, and in heat-sensitive sheets of × printability ratings, printability at lower densities was poor.

Examples 12 and 13

Two sheets coated with a heat-sensitive coating color and moisture-controlled to 5.5% and 7.0%, respectively, were prepared in the same manner as in Examples 1 to 11. These sheets were passed through a supercalender wherein the surface temperature of the chilled roll had been kept at 30° C., at an oil pressure of 15 kg/cm$^2$, whereby two heat-sensitive sheets were prepared. The test results are shown in Table 2.

Example 14

The sheet of Comparative Example 2 (coated with a heat-sensitive coating color and containing 6.0% of moisture before supercalender treatment) was passed through a moistener, whereby the moisture content was increased to 10.0%. Then, the resulting sheet was passed through a supercalender under the same conditions as in Examples 1 to 11, to obtain a heat-sensitive sheet. This heat-sensitive sheet was evaluated in the same manner as for Examples 1 to 11. The results are shown in Table 3.

TABLE 2

| No. | Location of the maximum peak of the void distribution curve of a heat-sensitive sheet, μm | Moisture content of a coated sheet when the sheet passes through a supercalender, % | Image density at each pulse width 1.0 msec | 1.5 msec | 2.0 msec | Printability |
|---|---|---|---|---|---|---|
| Example 12 | 0.90 | 5.5 | 0.37 | 0.75 | 0.96 | ○ |
| Example 13 | 0.85 | 7.0 | 0.38 | 0.76 | 0.98 | ○ |

TABLE 3

| No. | Location of the maximum peak of the void distribution curve of a heat-sensitive sheet, μm | Moisture content of a coated sheet when the sheet passes through a supercalender, % | Image density at each pulse width 1.0 msec | 1.5 msec | 2.0 msec | Printability |
|---|---|---|---|---|---|---|
| Example 14 | 0.8 | 10.0 | 0.37 | 0.76 | 0.99 | ◎ |

As is obvious from Tables 1 to 3, heat-sensitive sheets having maximum peaks of void distribution curves at smaller void diameters give superior printability and higher image densities. Also, it is shown from Table 1 that higher moisture contents of sheets before supercalendering give superior printability and higher image densities.

It is understood from Table 2 that even when the moisture content of the sheet is less than 6.5%, for example 5.5%, the location of maximum peaks of void distribution curves can be made lower by increasing the surface temperature of the chilled roll of a supercalender to 30° C. That is, in the sheet containing 5.5% of moisture, 1.1 μm (no heating of the chilled roll) moved to 0.90 μm (heating of the chilled roll at 30° C.) and in the sheet containing 7.0% of moisture, 0.9 μm (no heating of the chilled roll) moved to 0.85 μm (heating of the chilled roll at 30° C.). Resultantly, printability could be improved and image density could be enhanced.

Further, as is appreciated from Table 3, the sheet of Example 14 which had been subjected to drying (moisture content reduced to 6.0%), moisture readjustment (moisture content increased to 10%) and supercalendering showed, compared with the sheet of Example 8, about same printability but a slightly lower image density at a low pulse width (1.0 msec). However, compared with sheets of Comparative Examples 1 and 2, the sheet of Example 14 was far superior in both image density and printability.

What is claimed is:

1. A heat-sensitive recording sheet containing a colorless to light-colored dye precursor and a color developer which causes said dye precursor to develop a color by reacting with the dye precursor when heated, characterized by having the maximum peak of the void distribution curve at a void diameter of 1.0 μm or less.

2. A process for producing a heat-sensitive recording sheet which comprises coating on a substrate a heat-sensitive coating color containing mainly a colorless to light-colored dye precursor and a color developer which causes said dye precursor to develop a color by reacting with the dye precursor when heated and drying the coated substrate, characterized in that a sheet coated with a heat-sensitive coating color is moisture-controlled to 6.5 to 12.0% and then subjected to supercalendering to obtain a heat-sensitive recording sheet having the maximum peak of the void distribution curve at a void diameter of 1.0 μm or less.

3. A process according to claim 2, wherein the sheet coated with a heat-sensitive coating color is dried under a mild drying condition before being subjected to supercalendering to obtain the sheet having a moisture content of 6.5 to 12.0%.

4. A process according to claim 2, wherein the sheet coated with a heat-sensitive coating color is dried under an ordinary drying condition and the resulting sheet having a moisture content of 6.0% or lower is moisture-readjusted before being subjected to supercalendering to obtain a sheet having a moisture content of 6.5 to 12.0%.

5. A process for producing a heat-sensitive recording sheet which comprises coating on a substrate a colorless to light-colored dye precursor and a color developer which causes said dye precursor to develop a color by reacting with the dye precursor when heated and drying the coated substrate, characterized in that a sheet coated with a heat-sensitive coating color is subjected to supercalendering with the surface temperature of the chilled roll of a supercalender being kept at 30° C. or higher to obtain a heat-sensitive recording sheet having the maximum peak of the void distribution curve at a void diameter of 1.0 μm or less.

6. A process according to claim 5, wherein the sheet to be subjected to supercalendering has a moisture content of 6.5% or lower.

* * * * *